US010690424B2

(12) United States Patent
Bulman

(10) Patent No.: US 10,690,424 B2
(45) Date of Patent: Jun. 23, 2020

(54) HYPERVELOCITY CANNON

(71) Applicant: Aerojet Rocketdyne, Inc., Sacramento, CA (US)

(72) Inventor: Melvin J. Bulman, Fiar Oaks, CA (US)

(73) Assignee: Aerojet Rocketdyne, Inc., Rancho Cordova, CA (US)

( * ) Notice: Subject to any disclaimer, the term of this patent is extended or adjusted under 35 U.S.C. 154(b) by 0 days.

(21) Appl. No.: 16/088,485

(22) PCT Filed: May 31, 2017

(86) PCT No.: PCT/US2017/035160
§ 371 (c)(1),
(2) Date: Sep. 26, 2018

(87) PCT Pub. No.: WO2018/022189
PCT Pub. Date: Feb. 1, 2018

(65) Prior Publication Data

US 2019/0107346 A1 Apr. 11, 2019

Related U.S. Application Data

(60) Provisional application No. 62/366,368, filed on Jul. 25, 2016.

(51) Int. Cl.

| | |
|---|---|
| ***F41A 1/04*** | (2006.01) |
| ***F41A 1/02*** | (2006.01) |
| ***F42B 5/10*** | (2006.01) |
| ***F42B 14/08*** | (2006.01) |

(52) U.S. Cl.
CPC *F41A 1/02* (2013.01); *F41A 1/04* (2013.01); *F42B 5/105* (2013.01); *F42B 14/08* (2013.01)

(58) Field of Classification Search
CPC ..... F41A 1/04; F41A 1/02; F42B 5/16; F42B 5/02; F42B 14/08
USPC ..... 89/8, 7, 14.6; 102/440, 431, 520, 430
See application file for complete search history.

(56) References Cited

U.S. PATENT DOCUMENTS

| | | | | |
|---|---|---|---|---|
| 3,011,404 A | | 12/1961 | Russell | |
| 4,011,817 A | * | 3/1977 | Ashley | F41A 1/04 102/440 |
| 4,051,762 A | * | 10/1977 | Ashley | F41A 1/04 89/7 |
| 4,063,486 A | * | 12/1977 | Ashley | F41A 1/04 89/7 |
| 4,069,739 A | * | 1/1978 | Ashley | F41A 1/04 89/1.704 |
| 4,102,269 A | * | 7/1978 | Ashley | F41A 1/04 102/440 |

(Continued)

FOREIGN PATENT DOCUMENTS

| | | |
|---|---|---|
| DE | 1936973 | 2/1971 |
| DE | 1951153 | 5/1971 |
| DE | 3905061 | 6/1992 |

OTHER PUBLICATIONS

International Search Report and Written Opinion for International Application No. PCTUS2017035160 completed Dec. 5, 2017.

(Continued)

*Primary Examiner* — Michael D David

(57) ABSTRACT

A modified projectile includes a projectile, a container, and a liquid propellant in the container. The container is detachably attached to the projectile.

19 Claims, 4 Drawing Sheets

(56) References Cited

U.S. PATENT DOCUMENTS

| | | | | | |
|---|---|---|---|---|---|
| 4,126,078 | A | * | 11/1978 | Ashley | F41A 1/04 102/440 |
| 4,126,955 | A | * | 11/1978 | Coffield, Jr. | F41A 21/16 102/430 |
| 4,132,149 | A | * | 1/1979 | Ashley | F42B 5/16 89/1.704 |
| 4,336,741 | A | * | 6/1982 | Baines | F41A 1/04 89/7 |
| 7,377,204 | B2 | * | 5/2008 | Simmons | F41A 1/02 102/522 |

OTHER PUBLICATIONS

International Preliminary Report on Patentability for International Patent Application No. PCT/US2017/035160 completed Feb. 7, 2019.

* cited by examiner

HYPERVELOCITY CANNON

CROSS-REFERENCE TO RELATED APPLICATIONS

The present disclosure claims priority to U.S. Provisional Patent Application No. 62/366,368, filed Jul. 25, 2016.

BACKGROUND

Cannons are typically efficient in accelerating a projectile. However, the velocity of the projectile in the barrel of the cannon is limited. At high velocities in a cannon, the pressure on the base of the projectile drops rapidly as the projectile velocity exceeds the speed of sound in the gun gasses. The drop in the pressure at the base limits the projectile speed to a few times the speed of sound in the medium. A so-called "traveling charge" extends the velocity limit For example, to further accelerate the projectile, a traveling charge is ignited after both the charge and the projectile initially accelerate forward.

SUMMARY

A modified projectile according to an example of the present disclosure includes a projectile, a container, and a liquid propellant in the container. The container is detachably attached to the projectile.

A further embodiment of any of the foregoing embodiments includes an ignitor disposed at an aft end of the container.

In a further embodiment of any of the foregoing embodiments, the ignitor has a delay fuse.

In a further embodiment of any of the foregoing embodiments, the container abuts the projectile.

In a further embodiment of any of the foregoing embodiments, the container is formed of a container body disposed about a central axis of the container, and the container body defines an interior cavity that contains the liquid propellant.

In a further embodiment of any of the foregoing embodiments, the container body includes one or more radiused corners facing into the interior cavity.

In a further embodiment of any of the foregoing embodiments, the container body includes a forward and aft sections. The forward section is proximal relative to the projectile and the aft section is distal relative to the projectile. The aft section flares radially outward.

In a further embodiment of any of the foregoing embodiments, the container body includes one or more break-away joints at which the container fractures upon pressurization from ignition of the liquid propellant.

In a further embodiment of any of the foregoing embodiments, the one or more break-away joints includes one or more notches.

In a further embodiment of any of the foregoing embodiments, the container is formed of plastic.

In a further embodiment of any of the foregoing embodiments, the container is detachable from, and reattachable to, the projectile without destruction of the container and projectile.

A cannon according to an example of the present disclosure includes a barrel, and a modified projectile disposed in the barrel. The modified projectile has a projectile, a container, and a liquid propellant in the container. The container is detachably attached with the projectile.

In a further embodiment of any of the foregoing embodiments, the barrel includes a bore that has a bore inside diameter. The container is formed of a container body disposed about a central axis of the container. The container body defines a container outside diameter, and the container outside diameter is equal to or greater than the bore inside diameter.

In a further embodiment of any of the foregoing embodiments, the container is formed of a container body disposed about a central axis of the container, and the container body defines an interior cavity that holds the liquid propellant.

In a further embodiment of any of the foregoing embodiments, the barrel includes a bore and rifling along the bore. The container body includes a forward and aft sections, where the forward section is proximal relative to the projectile and the aft section is distal relative to the projectile, and the aft section flares radially outward such that the aft section interferes with the rifling when the modified projectile is launched through the bore.

In a further embodiment of any of the foregoing embodiments, the container body includes one or more break-away joints at which the container preferentially fractures upon pressurization from ignition of the liquid propellant.

In a further embodiment of any of the foregoing embodiments, the one or more break-away joints includes one or more notches.

A further embodiment of any of the foregoing embodiments a chamber charge in the barrel. The container is configured to travel with the projectile along the barrel upon ignition of the chamber charge.

A cannon according to an example of the present disclosure includes a barrel, a chamber charge in the barrel, and a modified projectile disposed in the barrel. The modified projectile has a projectile, a container, a liquid propellant in the container, and an ignitor disposed at an aft end of the container. The container is disposed aft of the projectile and is not attached to the projectile.

In a further embodiment of any of the foregoing embodiments, the container is formed of a container body that defines an interior cavity that contains the liquid propellant.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

Figure 1:
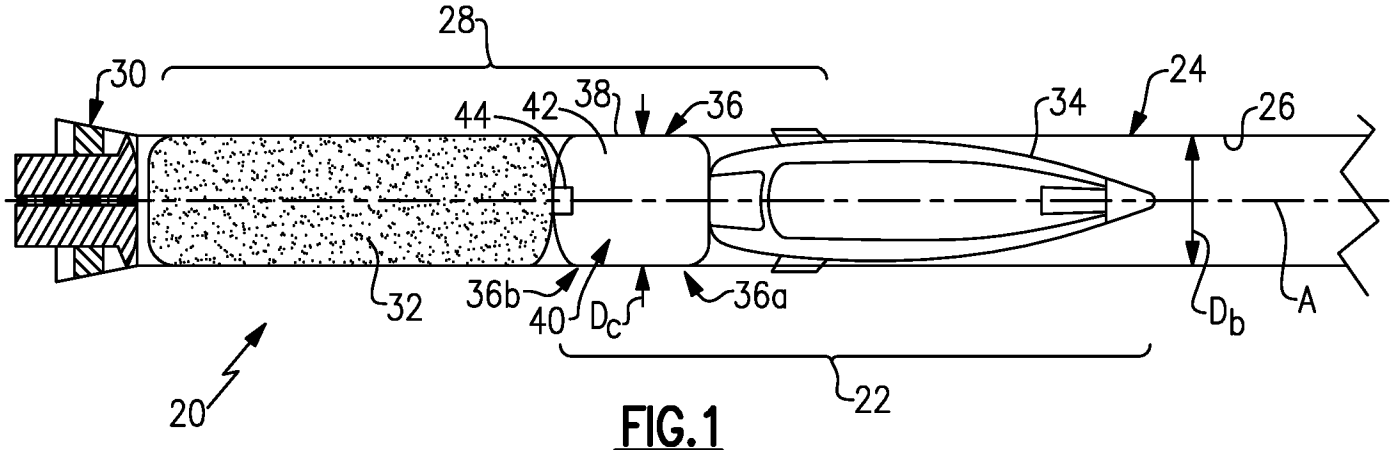
FIG. 1 illustrates an example cannon and modified projectile.

FIG. 1 schematically illustrates an example cannon 20 and modified projectile 22. The modified projectile 22 includes a traveling charge 42, to provide enhanced acceleration beyond what is provided by an initial chamber charge to accelerate a projectile and provide increased operational range. As will also be described, a modified projectile according to the disclosed examples may be retrofitted to existing cannons, thereby avoiding the need for a new cannon that is designed for an outsized projectile geometry.

The cannon 20 includes a barrel 24 that defines a bore 26. As shown, the modified projectile 22 is disposed in a chamber portion 28 of the bore 26. The cannon 20 includes a breech 30 at the non-firing end of the barrel 24, although the examples herein are not limited to breech style cannons, guns, or firearms. In this example, the cannon 20 includes a chamber charge 32. The barrel 24, modified projectile 22, and chamber charge 32 are generally disposed about a central axis A. As will be appreciated, the cannon 20 may include additional components related to the operation thereof, which are generally known and thus not described herein.

The modified projectile 22 in this example includes a projectile 34 and a container 36. The container 36 serves for the travelling charge functionality of the projectile 22. The container 36 is formed of a container body 38 that defines an interior cavity 40 that holds a liquid propellant 42 therein. The container 36 seals the liquid propellant in the interior cavity 40, including sealing the liquid propellant 42 during initial acceleration of the modified projectile 22. The container 36 may also serve as a barrier to gun gases (produced from the combustion of the chamber charge 32) entering into the interior cavity 40. In this example, the modified projectile 22 is shown with an ignitor 44 that is operable to ignite the liquid propellant 42.

In one example, the container body 38, and optionally at least a portion of the ignitor 44, exclusively seal the liquid propellant in the interior cavity 40. That is, the container body 38, or the container body 38 and the ignitor 44, contain the liquid propellant 42 in the interior cavity 40, and none of the projectile 34, the barrel 24, and the chamber charge 32 contact, bound, or contain the liquid propellant 42.

The modified projectile 22 is designed for the container 36, and thus also the liquid propellant 42, to travel with the projectile 34 down the barrel 24 upon initial ignition of the chamber charge 32. For instance, the container 36 configured to travel with the projectile 34 by abutting the projectile and/or by being attached with the projectile 34, such as via a mechanical attachment. With ignition of the chamber charge 32 the container 36 and liquid propellant 42 are initially launched forward down the barrel 24 with the projectile 34. At the initial stage of acceleration, the container 36 remains adjacent to or attached to the projectile 34. For instance, if initially attached before firing, the attachment of the container 36 to the projectile 34 keeps the liquid propellant 42 in close proximity to the projectile 34 as the projectile 22 moves down the barrel 24. If the container abuts the projectile 34 but is not initially attached prior to firing, sealing between the container 36 and the barrel 24 prevents substantial pressurization forward of the container 36 to keep the container 36 and liquid propellant 42 in close proximity to the projectile 34 as the projectile 22 moves down the barrel 24.

After a delay from the initial acceleration, the ignitor 44 ignites the liquid propellant 42. The liquid propellant 42 combusts and initially begins to take the shape of a "Taylor Cavity." The parabolic shape of the Taylor Cavity increases the burning surface by approximately an order of magnitude. As the combustion gases move toward the moving projectile 34, the Rayleigh/Helmholtz instability generates waves and then droplets in a thin sheet of propellant at the rear of the Taylor Cavity, i.e., a stabilized Taylor Cavity. The droplets provide an additional increase of approximately two orders of magnitude in the burning surface area of the propellant.

The rapid increase in pressure from combustion of the liquid propellant 42 in the container 36 fractures the container 36. The container 36, or at least a substantial portion thereof, sheds from the modified projectile 22. In this regard, the container 36 is detachable, or more precisely pressure-detachable or destructively detachable, from the projectile 34. The combusting liquid propellant 42, which is located close the projectile 34 due to the container 36, closely follows and accelerates the projectile 34 after shedding of the container 36 as combustion continues.

The cannon 20 and/or projectile 22 may include additional features to enhance operation thereof. In one example included in FIG. 1, the container 36 seals against the barrel 24. For instance, the bore 26 of the barrel 24 has a bore inside diameter, indicated at Db, and at least a portion of the container body 38 has a container outside diameter, indicated at Dc. The dimension Dc is equal to or greater than the dimension Db such that the container 36 interferes with the sides of the bore 26 as the container 36 moves down the barrel 24. The interference fit serves as a seal to limit gun gas from leaking past the container 36. Gun gas that leaks around the container 36 may later tend to push apart the combusting liquid propellant 42 from the projectile 34 after the container 36 sheds, thereby potentially reducing the effectiveness of the liquid propellant 42 for accelerating the projectile 34. Limiting gun gas leakage around the container 36 may thus enhance acceleration.

The size of the dimension Dc is not so large though as to prevent insertion of the modified projectile 22 into the barrel 24 or hinder launching of the modified projectile 22. For example, as long as the modified projectile 22 can be inserted into the barrel 24 and not hinder launching, the modified projectile 22 may be conducive to use with existing cannons or to retrofit with existing cannons with modification of the cannon.

To further reduce the potential effect of leaked gun gas around the container 36, the container 36 is located close to the projectile 34. As shown in FIG. 1, the container 36 includes a forward section **36*a* and an aft section 36*b*. The forward section 36 is proximal the projectile 34 and the aft section 36*b* is distal from the projectile 34. As shown, at least a portion of the forward section 36*a* abuts or contacts the projectile 34. Such an abutment may or may not include an attachment between the container 36 and the projectile 34. To the extent there is a gap between the container 36 and the projectile 34, the abutment between the container 36 and the projectile 34 reduces or eliminates such a gap. If gun gas leaks around the container 36, the reduced size of the gap limits the amount of gun gas between the container 36 and projectile 34, and thus limits the effect of the gun gas pushing apart the combusting liquid propellant container 36 from the projectile 34**.

Figure 2:
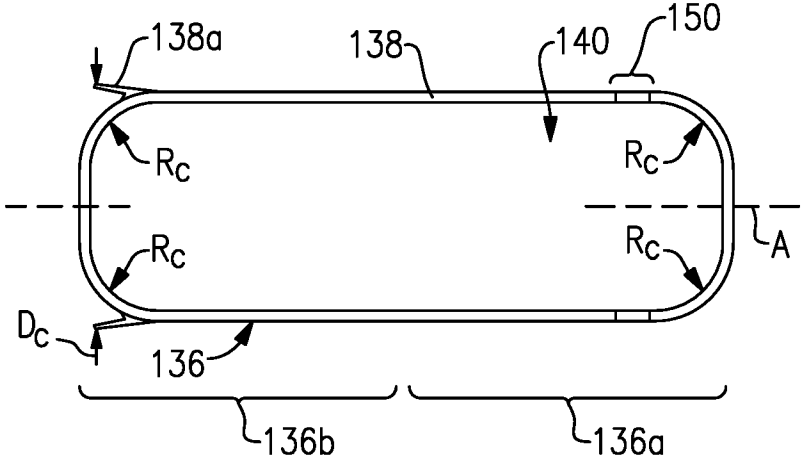
FIG. 2 illustrates an isolated view of a container of a modified projectile.

FIG. 2 illustrates an isolated, sectioned view (sectioned in a plane containing the central axis A) of another example container 136 which may be used in the cannon 20 and modified projectile 22. In this disclosure, like reference numerals designate like elements where appropriate and reference numerals with the addition of one-hundred or multiples thereof designate modified elements that are understood to incorporate the same features and benefits of the corresponding elements. The container 136 demonstrates several features to enhance performance, which in modified examples may be used individually or together in full or partial combinations.

The container 136 is formed of a container body 138 that defines an interior cavity 140. The container body 138 may be composed of plastic. Example plastics may include polymers that are capable of being molded (e.g., blow molded) into the hollow geometry of the container 136 and, in such a geometry, able to withstand the gas pressures and temperatures in the cannon 20 without fracturing or melting prior to ignition of the liquid propellant 42 held in the interior cavity 140. As a further example, the polymer is a thermoplastic polymer with the above characteristics.

The container body 138 includes one or more radiused corners, indicated at Rc, that face into the interior cavity 140. In this example, the container body 138 includes a forward section 136*a* and an aft section 136*b*, which are oriented relative to the projectile 34 as discussed above for the container 36. The forward section 136*a* includes two radiused corners Rc, and the aft section 136*b* includes two radiused corners Rc. The container body 138 thus has a generally cylindrical geometry.

Upon ignition of the chamber charge 32 and prior to ignition of the liquid propellant 42, the pressure of the gun gas generated from the chamber charge 32 compresses the container body 138. The compression axially shortens the container body 138, causing the container body to expand radially against the barrel 24. Upon ignition and combustion of the liquid propellant 42, the interior cavity 140 pressurizes. The radiused corners Rc distribute the pressure on the container body 138 to help keep the container body 138 from prematurely breaking during initial combustion of the liquid propellant 42. In comparison, sharp corners may concentrate the pressure and stress, and thus increase the potential that the container body 138 would prematurely break during initial combustion of the chamber charge 32. As an example, the radiused corners Rc have a radius of curvature of at least 5% of Dc.

Another feature demonstrated by the container 136 relates to sealing the gun gases from leaking around the container 136 in the barrel 24. Here, the container body 138 includes a lip 138*a* that tapers outward. For example, the lip 138*a* may be a radial projection that extends around the circumference of the container body 138. The lip 138*a* defines the container outside diameter Dc. For instance, the dimension Dc is taken at a axially aft tip of the lip 138*a*, although a substantial portion of, or all of, the lip 138*a* may actually have a greater diameter than the bore inside diameter Db. Most typically, the minimum diameter of the container body 138 will also be equal to or greater than the bore inside diameter Db. The lip 138*a* serves as a seal against the barrel 24 to reduce gun gas leakage.

Figure 3:
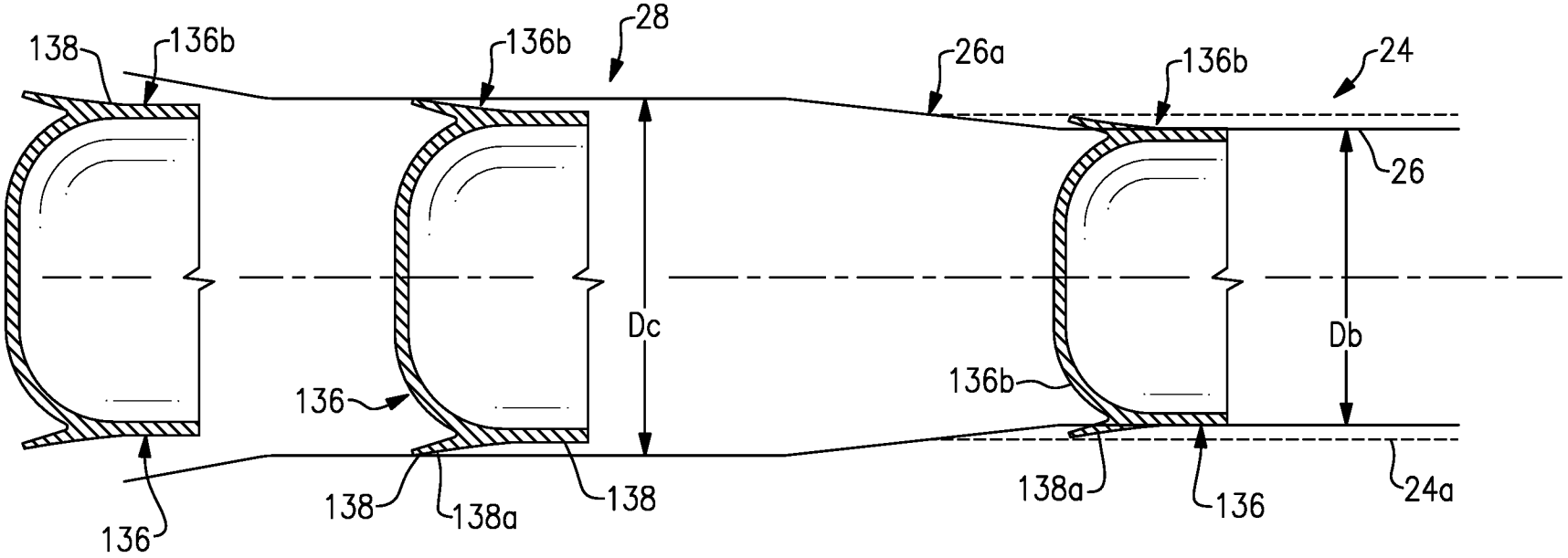
FIG. 3 illustrates a sectioned view of a portion of a barrel of a cannon and a flange of a container of a modified projectile.

More significantly, as shown in FIG. 3, the radial projection of the lip 138*a* beyond the chamber inside diameter Dc permits additional sealing capability. In this example, a representative portion of a section of the barrel 24 and chamber 28 are shown, prior to loading the container 136, when the container 136 is in the chamber 28, and when the container 136 moves down the barrel 24. The barrel 24 may include rifling 24*a* along the bore 26. As will be appreciated, the rifling 24*a* may be, but is not limited to, spiral grooves along the bore 26. The radial projection of the lip 138 permits the lip 138*a* to extend into the rifling 24*a* when the container 136 moves through a tapered "forcing cone" 26*a* of the bore 26 such that at least the lip 138*a* of the aft section 136*b* of the container body 138 interferes with the rifling 24*a* when the modified projectile 22 is launched through the bore 26. The interference between the lip 138*a* and the rifling 24*a* creates a rifling seal that further limits gun gas from leaking around the container 136 via the rifling 24*a*.

Another feature demonstrated by the container 136 relates to detachment, or pressure-detachment, of the container 136 from the projectile 34. As shown in FIG. 2, the container body 138 includes one or more break-away joints 150. The break-away joints 150 are locations at which the container 136 preferentially fractures upon pressurization from ignition of the liquid propellant 42, to shed the container 136 from the projectile 34. In this example, the break-away joint 150 is located in the forward section 136*a* of the container 136, such as in or near the corners of the interior cavity 140. The forward location of the break-away joints 150, once fractured, permits a majority of the container 136 to be shed away.

For example, the break-away joints 150 are localized weak points in the container body 138 which have a lower tensile strength than adjacent sections of the container body 138. Most typically, the break-away joints 150 will have lowest strength of any location on the container body 138 to ensure that the container 136 initially fractures at the break-away joints 150. In some examples, the pressure (e.g., stress) at which the break-away joints 150 fracture is controlled through geometry of the container body 138, i.e., the container body 138 has a geometry in the break-away joints 150 that concentrates the pressure in the interior cavity 140 at that location to ensure that the container body 138 first fractures at that location.

Figure 4:
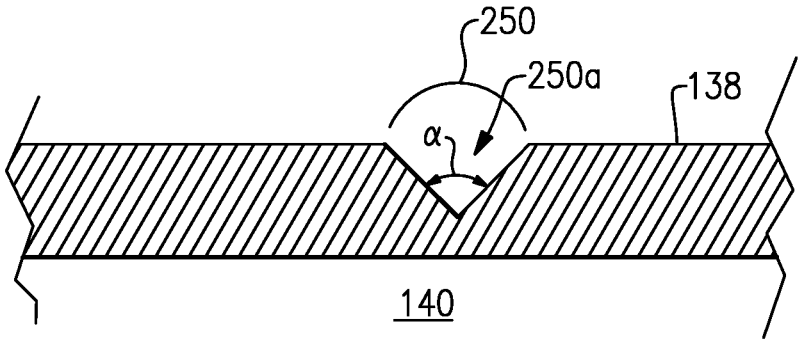
FIG. 4 illustrates an example of a break-away joint of a container of a modified projectile in which the joint includes a notch.

FIG. 4 illustrates a further example of a break-away joint 250. In this example, the break-away joint 250 of the container body 138 includes a notch 250*a*. For example, the notch 250*a* is an endless groove that extends circumferentially around the container body 138. In an alternative example, the notch 250*a* is discrete and does not extend endlessly around, or at least entirely around, the container body 138. The notch 250*a* in this example is on the exterior of the container body 138. For instance, after forming the container body 138 in a molding process, the notch 250 may be machined into the exterior. Alternatively, the notch 250*a* may be on the cavity side of the container body 138, although formation by machining may be limited. In this case, the notch 250*a* may be a molded-in feature.

Figure 5:
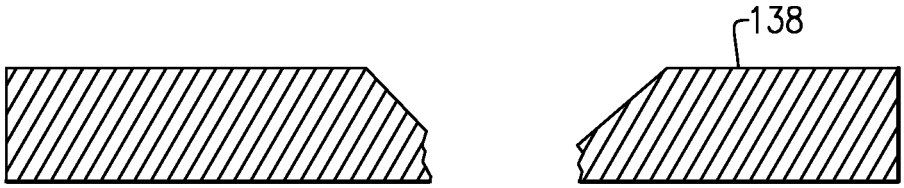
FIG. 5 illustrates the joint of FIG. 4 after fracture.

The notch 250*a* serves as a stress concentrator to ensure that the container body 138 initially fractures at the break-away joint 250. An example of a fracture at the notch 250*a* is depicted in FIG. 5. In further examples, the break-away joint 250 may include one or more additional notches, which may be on the exterior side of the container body 138, the cavity side of the container body 138, or both.

In the illustrated example, the notch 250*a* has distinct faces that meet to form an interior corner angle, indicated at $\alpha$ (alpha), at which stress is concentrated. In alternative examples, the notch 250*a* may be indistinct, such as a localized thin portion, or localized thinnest portion, of the container body 138.

Figure 6:
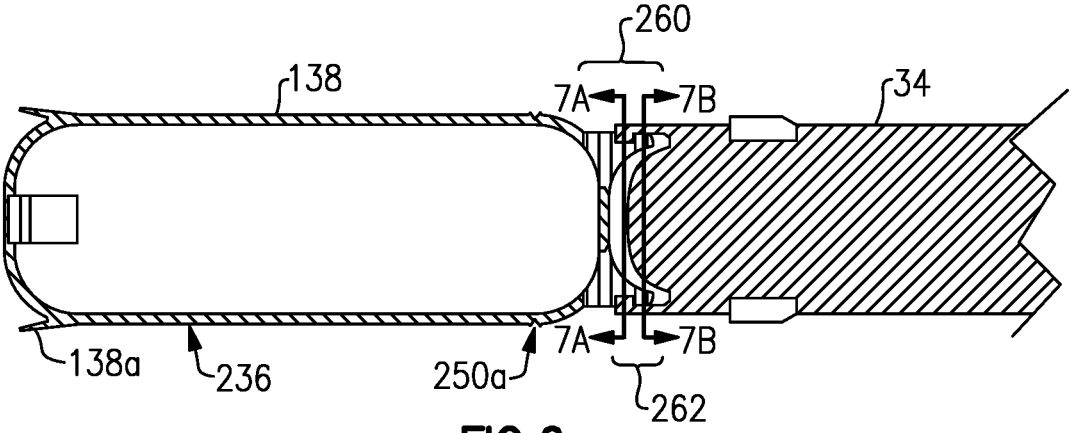
FIG. 6 illustrates an example of a modified projectile in which a container is mechanically connected to a projectile.
Figure 7A:
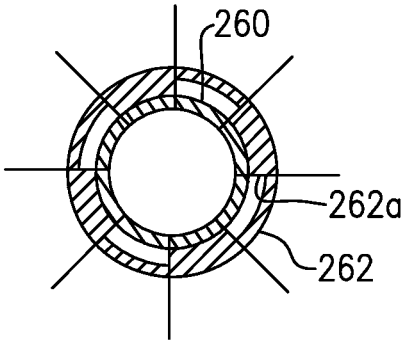
FIGS. 7A and 7B illustrate respective sectioned views according to section lines shown in FIG. 6.
Figure 7B:
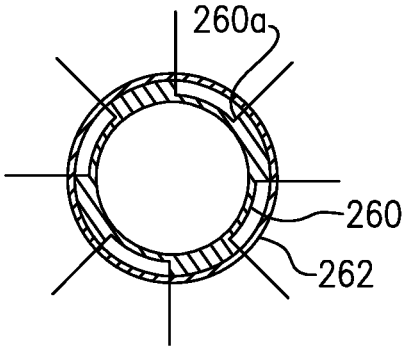

FIG. 6 illustrates another example container 236 that is similar to the container 136 but includes a mechanical connector portion 260. The mechanical connector portion 260 is configured to connect to a mating mechanical connector portion 262 on the projectile 34. In this example, the mechanical connector portions 260/262 form an "interrupted lug." As shown in the sectioned view in FIG. 7A, the mechanical connector portion 262 of the projectile 34 includes projectile lugs 262*a*. For example, the projectile lugs 262*a* are a series of circumferentially-spaced lugs that project radially inwards. As shown in the sectioned view in FIG. 7B, the mechanical connector portion 260 of the container 236 includes container lugs 260*a*. For example, the container lugs 260*a* are a series of circumferentially-spaced flanges that project radially outwards.

The container lugs 260*a* are circumferentially-spaced to align with the spaces between the circumferentially-spaced projectile lugs 262*a*. To secure the container 236 to the projectile 34, the container lugs 260*a* can be moved axially through the circumferential spaces between the projectile lugs 262*a* to a position beyond the projectile lugs 262*a*. The container 236 and projectile 34 are then rotated relative to each other so that the lugs 260*a* axially align with the lugs 262*a*. The lugs 260*a*/262*a* may be sized such that there is interference there between to provide a secure fit. As will be appreciated, the radial projection direction of the lugs 260*a*/262*a* could be inverted in an alternative example. In further examples, the break-away joints described herein may be incorporated into the mechanical connector portions or the mechanical connection may be configured with predetermined weak points so that fracture occurs in the mechanical connector portions upon ignition of the liquid propellant 42 to release the container.

Alternative to an interrupted lug connection, other mechanical connections could be used such as, but not limited to, threaded or helical connections. As will be appreciated, there are two forms of "detachability" herein. One form is the pressure-detachability associated with controlled break-away of the container from the projectile. Another form is the mechanical detachability associated with the physical connection of the container to the projectile. In additional examples, permanent connections may be used (if a positive mechanical connection is not needed).

Mechanical connections may include joints that connect the container and projectile, in which the container is detachable from, and reattachable to, the projectile without destruction of the container and projectile for their intended use and without destruction of the joint. Permanent connections are joints that connect the container and projectile, in which the container is not readily detachable from, and reattachable to, the projectile without destruction of the container, projectile, and/or the joint.

Figure 8:
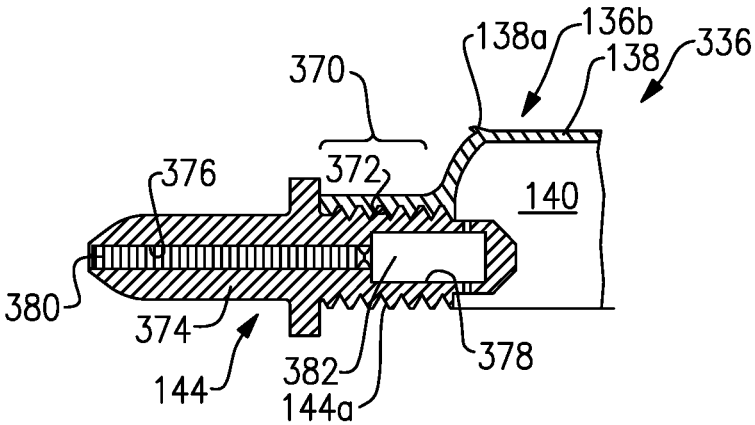
FIG. 8 illustrates an example container of a modified projectile and connection with an ignitor.

FIG. 8 illustrates a sectioned view of a portion of another example container 336 that is similar to the container 136 but includes ignitor connector portion 370 for securement of an ignitor 144 to the aft section 136*b* of the container body 138 of the container 336. In this example, the connector portion 370 includes threads 372 and the ignitor 144 includes mating threads 144*a*, which when engaged with threads 372 secure the ignitor 144 to the container 336.

In this example, the ignitor 144 includes an ignitor body 374 that defines an ignitor bore 376 and a charge chamber 378. The charge chamber 378 opens into the interior cavity 140, and the ignitor bore 376 opens into the charge chamber 378. The ignitor bore 376 contains a fuse 380, and the charge chamber contains an ignition charge 382.

Upon ignition of the chamber charge 32 in the chamber portion 28 of the barrel 26 (FIG. 1), the combusting chamber charge 32 ignites the fuse 380. The fuse 380 provides a controlled delay between ignition of the chamber charge 32 and ignition of the liquid propellant 42. The fuse 380 burns or is otherwise consumed down to the ignition charge 382, which is then ignited by exposure to the hot gun gas from the chamber charge 32. The ignition charge 382 ignites, thereby igniting the liquid propellant 42.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from this disclosure. The scope of legal protection given to this disclosure can only be determined by studying the following claims.

What is claimed is:

1. A modified projectile comprising:

a projectile disposed about an axis; and a container and a liquid propellant in the container, the container being detachably attached to the projectile by a mechanical connector such that the container is detachable from, and reattachable to, the projectile without destruction of the container and projectile, the mechanical connector including a connector portion having circumferentially-spaced lugs that project radially inwardly and a mating connector portion having circumferentially-spaced flanges that project radially outwardly, the circumferentially-spaced flanges fitting through circumferential spaces between the circumferentially-spaced lugs to a position beyond the circumferentially-spaced lugs and then being rotatable to interlock and secure the projectile and container together.

2. The modified projectile as recited in claim 1, further comprising an ignitor disposed at an aft end of the container.

3. The modified projectile as recited in claim 2, wherein the ignitor has a delay fuse.

4. The modified projectile as recited in claim 1, wherein the container abuts the projectile.

5. The modified projectile as recited in claim 1, wherein the container is formed of a container body disposed about a central axis of the container, and the container body defines an interior cavity that contains the liquid propellant.

6. The modified projectile as recited in claim 5, wherein the container body includes one or more radiused corners facing into the interior cavity.

7. The modified projectile as recited in claim 5, wherein the container body includes a forward and aft sections, the forward section being proximal relative to the projectile and the aft section being distal relative to the projectile, and the aft section flares radially outward.

8. The modified projectile as recited in claim 5, wherein the container body includes one or more break-away joints at which the container fractures upon pressurization from ignition of the liquid propellant.

9. The modified projectile as recited in claim 8, wherein the one or more break-away joints includes one or more notches.

10. The modified projectile as recited in claim 9, wherein the container is formed of plastic.

11. A cannon comprising:

a barrel; and a modified projectile disposed in the barrel, the modified projectile including, a projectile, and a container and a liquid propellant in the container, the container being detachably attached to the projectile by a mechanical connector such that the container is detachable from, and reattachable to, the projectile without destruction of the container and projectile, the mechanical connector including a connector portion having circumferentially-spaced lugs that project radially inwardly and a mating connector portion having circumferentially-spaced flanges that project radially outwardly, the circumferentially-spaced flanges fitting through circumferential spaces between the circumferentially-spaced lugs to a position beyond the circumferentially-spaced lugs and then being rotatable to interlock and secure the projectile and container together.

12. The cannon as recited in claim 11, wherein the barrel includes a bore that has a bore inside diameter, the container is formed of a container body disposed about a central axis of the container, the container body defines a container outside diameter, and the container outside diameter is equal to or greater than the bore inside diameter.

13. The cannon as recited in claim 11, wherein the container is formed of a container body disposed about a central axis of the container, and the container body defines an interior cavity that holds the liquid propellant.

14. The cannon as recited in claim 13, wherein the container body includes one or more break-away joints at which the container preferentially fractures upon pressurization from ignition of the liquid propellant.

15. The cannon as recited in claim 14, wherein the one or more break-away joints includes one or more notches.

16. The cannon as recited in claim 11, wherein the exterior of the container includes a lip projecting radially outwardly there from and extending circumferentially around the container.

17. The cannon as recited in claim 16, wherein an outer diameter of the container taken at the lip is greater than an inner diameter of the barrel.

18. The modified projectile as recited in claim 1, wherein the exterior of the container includes a lip projecting radially outwardly there from and extending circumferentially around the container.

19. A cannon comprising:

a barrel; and a modified projectile disposed in the barrel, the modified projectile including, a projectile, and a container and a liquid propellant in the container, the container being detachably attached to the projectile with a mechanical connector, the mechanical connector including a connector portion having circumferentially-spaced lugs that project radially inwardly and a mating connector portion having circumferentially-spaced flanges that project radially outwardly, the circumferentially-spaced flanges fitting through circumferential spaces between the circumferentially-spaced lugs to a position beyond the circumferentially-spaced lugs and then being rotatable to interlock and secure the projectile and container together.

* * * * *